US008393036B2

(12) United States Patent
Mastio et al.

(10) Patent No.: US 8,393,036 B2
(45) Date of Patent: Mar. 12, 2013

(54) APPARATUS FOR CLEANING AN IMMERSED SURFACE WITH GYRATION BY MEANS OF A NOSING-UP ACTION

(75) Inventors: Emmanuel Mastio, Fourquevaux (FR); Philippe Blanc-Tailleur, Toulouse (FR); Philippe Pichon, Villeneuve de Riviere (FR)

(73) Assignee: Zodiac Pool Care Europe, Paris (FR)

( * ) Notice: Subject to any disclaimer, the term of this patent is extended or adjusted under 35 U.S.C. 154(b) by 166 days.

(21) Appl. No.: 12/971,288

(22) Filed: Dec. 17, 2010

(65) Prior Publication Data

US 2011/0154586 A1 Jun. 30, 2011

Related U.S. Application Data

(60) Provisional application No. 61/300,520, filed on Feb. 2, 2010, provisional application No. 61/356,687, filed on Jun. 21, 2010.

(30) Foreign Application Priority Data

Dec. 18, 2009 (FR) ..... 09 06141
Apr. 16, 2010 (FR) ..... 10 01640

(51) Int. Cl.
*E04H 4/16* (2006.01)

(52) U.S. Cl. ..... 15/1.7

(58) Field of Classification Search ..... 15/1.7; 210/167.1, 167.16, 167.17, 416.2, 459
See application file for complete search history.

(56) References Cited

U.S. PATENT DOCUMENTS 4,168,557 A * 9/1979 Rasch et al. ..... 15/1.7
5,245,723 A 9/1993 Sommer
6,365,039 B1 * 4/2002 Henkin et al. ..... 210/103
2003/0159723 A1 * 8/2003 Hui ..... 134/167 R
2004/0168838 A1 9/2004 Erlich et al.
2006/0101596 A1 * 5/2006 Hui et al. ..... 15/1.7
2007/0157413 A1 7/2007 Roumagnac
2008/0236628 A1 10/2008 Horvath et al.

FOREIGN PATENT DOCUMENTS

| | | | |
|---|---|---|---|
| EP | 1022411 | | 7/2000 |
| EP | 1070850 | | 1/2001 |
| FR | 2584442 | | 1/1987 |
| FR | 2729995 | A1 * | 8/1996 |
| FR | 2896005 | | 7/2007 |
| FR | 2567552 | | 6/2009 |
| FR | 2925552 | | 6/2009 |

OTHER PUBLICATIONS

FR 2729995 Al (English Abstract).*

* cited by examiner

*Primary Examiner* — Monica Carter
*Assistant Examiner* — Andrew A Horton
(74) *Attorney, Agent, or Firm* — Dean W. Russell; Kilpatrick Townsend & Stockton LLP

(57) ABSTRACT

Detailed is an apparatus for cleaning a surface which is immersed in a liquid including a body, guiding members defining at least one axle, a filtration chamber, at least one electric drive motor, a control unit which is configured to control each drive motor in at least one direction at a speed selected from:

Figure 1:
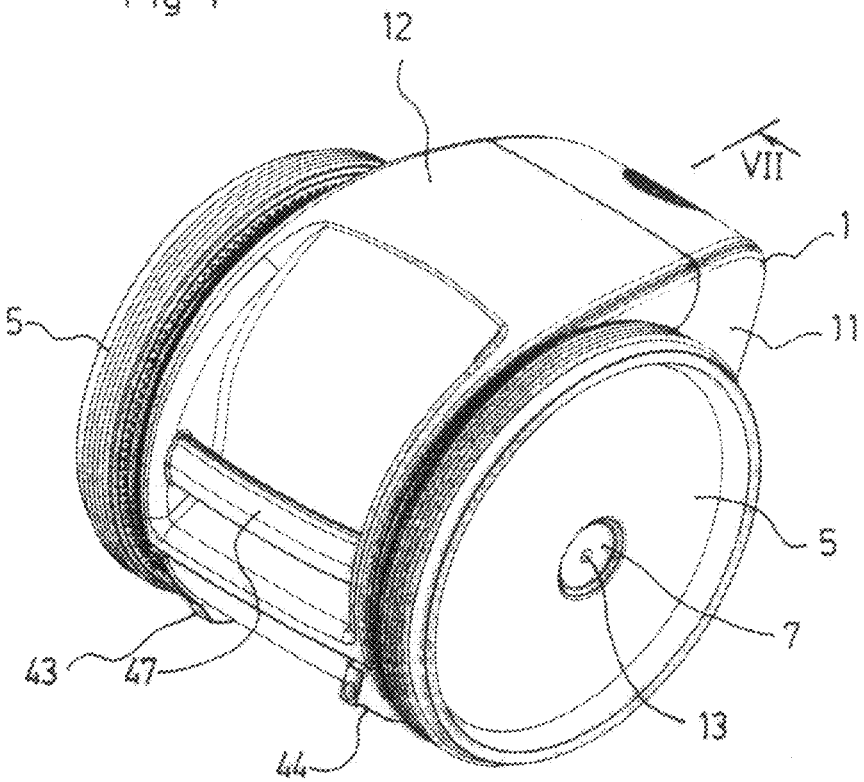
Figure 2:
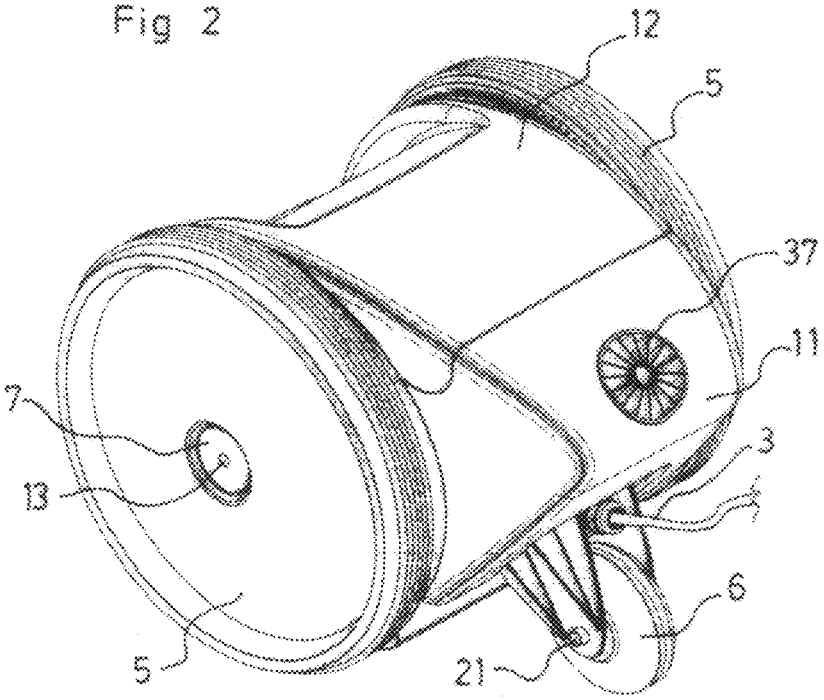
Figure 3:
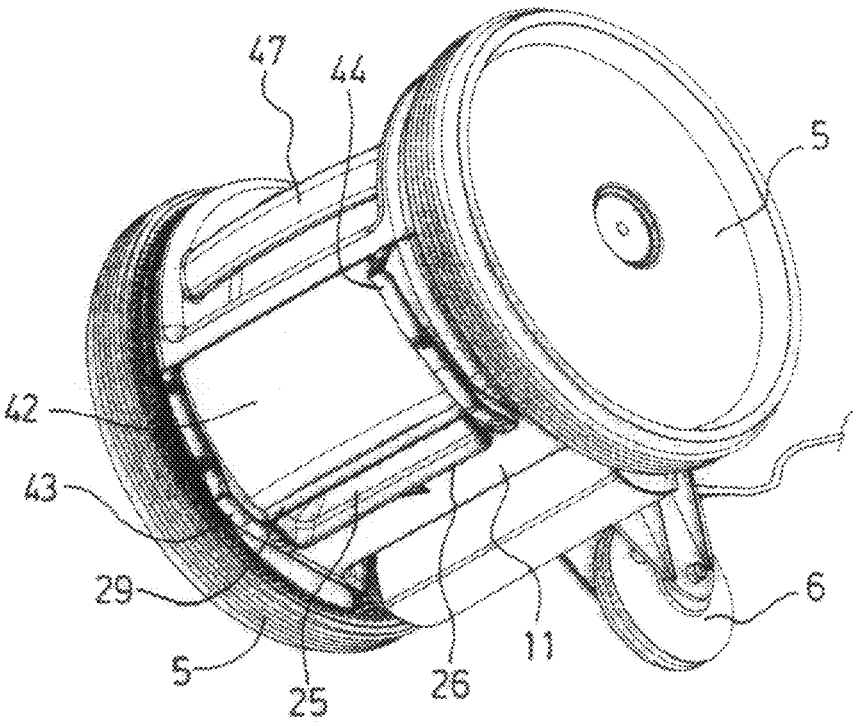

at least a first speed at which the apparatus is in a first movement position in accordance with a first predetermined trajectory, at least a second more rapid speed at which the apparatus is in a second nosed-up movement position in accordance with a second predetermined trajectory which is different from the first trajectory.

10 Claims, 12 Drawing Sheets

XI-IX
XI-IX
2
3
5
6
8
9
10
11
12
14
18
19
20
21
22
23
24
25
26
28
29
31
32
33
34
35
36
37
38
39
40
41
42
43
α

APPARATUS FOR CLEANING AN IMMERSED SURFACE WITH GYRATION BY MEANS OF A NOSING-UP ACTION

This application claims the benefit of French Patent Application No. 09.06141 filed on Dec. 18, 2009; claims the benefit of U.S. Provisional Application No. 61/300,520 filed on Feb. 2, 2010; claims the benefit of French Patent Application No. 10.01640 filed on Apr. 16, 2010; and claims the benefit of U.S. Provisional Application No. 61/356,687 filed on Jun. 21, 2010, the entireties of all of which are incorporated herein by reference.

The invention relates to an apparatus for cleaning a surface which is immersed in a liquid, such as that formed by the walls of a swimming pool, of the self-propelling type with (an) electric motor(s).

There are a great number of apparatus of this type which have been known for some time (cf. typically FR 2 567 552, FR 2 584 442, etc.) and they generally comprise a hollow body; one (or more) electric drive motor(s) which is/are coupled to one or more member(s) for guiding and driving said body over the immersed surface; and an electric pumping motor which drives a pumping member, such as a propeller, which generates a liquid flow between at least one liquid inlet and at least one liquid outlet and through a filtration chamber.

These apparatus are satisfactory but are relatively heavy and costly to produce and use, in particular in terms of electrical consumption.

There have already been proposed apparatus with a single electric motor which serve to simultaneously produce the driving of the apparatus and the pumping of the liquid. However, these apparatus present a problem in terms of cleaning efficiency (speed and/or quality of sweeping the entire surface and/or debris pumping capacity), which assumes in particular that the apparatus can move forwards or backwards along varied trajectories, which may be straight or curved, to the left and to the right.

In prior apparatus in which the pumping is ensured by an on-board electric motor, and the driving is also ensured by at least one on-board electric motor, if the apparatus must be bi-directional, that is to say, able to carry out forward and backward trajectories, the possibility of using the electric pumping motor for moving the apparatus is generally excluded, unless a pumping member such as a "vortex" pump or a centrifugal pump is provided (cf. for example U.S. Pat. No. 5,245,723), or a pump with articulated blades (cf. for example EP 1 070 850), which is capable of providing a flow of liquid in the same direction regardless of the rotation direction thereof, but whose pumping performance levels are mediocre. Furthermore, in this latter case, the trajectories of the apparatus are limited to two predetermined trajectories, one forward and the other backward, that is to say, in practice trajectories which are straight or which gyrate only at one side. There is consequently poor sweeping coverage of the immersed surface which is either not completely cleaned or is completely cleaned only at the end of an excessively long period of time.

In another category of apparatus, there is provision for the driving and/or orientation of the apparatus to be at least partially carried out by the hydraulic reaction brought about by the flux generated by the pumping action. In this manner, for example, EP 1 022 411 (or US 2004/0168838) describes an apparatus which is capable of being partially driven by the hydraulic flux created and has two nozzle outlets which have opposing directions and are supplied alternately via a valve which is operated when the pump is stopped. Owing to wheels which are self-pivoting or which have pivoting axles, the forward and backward trajectories are different. However, apparatus of this type are relatively complex, costly and unreliable, in particular with regard to the control of the tilting of the valve (or more generally for the change in direction of the hydraulic flux) which requires an operating logic unit and at least one on-board actuator and/or a specific mechanism which is capable of being locked. Furthermore, in this instance too, only two different predetermined trajectories are possible.

An object of the invention is therefore generally to provide a cleaning apparatus of the type having (an) on-board electric motor(s) which is both more economical in terms of production and use and which has high performance levels which are comparable with those of known apparatus, in terms of quality and cleaning, and more particularly which provides complete and rapid sweeping of the immersed surface and good suction quality for collecting waste with a satisfactory performance level in terms of energy.

An object of the invention is thus to provide an apparatus of this type which is particularly simple, reliable, compact and light but which has significant movement possibilities.

An object of the invention in one specific embodiment is to provide an apparatus of this type which comprises a single electric on-board driving and pumping motor and which can be driven in at least three different predetermined trajectories, in particular in a straight line, curved to one side and curved to the other side.

An object of the invention is also to provide an apparatus of this type whose electric control unit is particularly simple and economical and can be located entirely out of the liquid.

The invention therefore relates to an apparatus for cleaning a surface which is immersed in a liquid, comprising:

a hollow body, guiding members for guiding said hollow body over the immersed surface, comprising at least one axle which is provided with at least one rolling member, a filtration chamber provided in said hollow body and having:

at least one liquid inlet into the hollow body, at least one liquid outlet out of the hollow body, a hydraulic circuit for circulation of liquid between each liquid inlet and each liquid outlet through a filtering device, at least one mechanical electric drive motor which is carried by said hollow body and which is arranged to generate a movement of said hollow body over the immersed surface, an electric control unit which is connected to each mechanical drive motor to supply it with electrical power and to control it in at least one movement direction, characterized in that said electric control unit is configured to control each drive motor in at least one movement direction of the apparatus and at a speed selected from:

at least a first speed at which the apparatus is in a first movement position relative to the immersed surface and moves in said at least one movement direction in accordance with a first predetermined trajectory, at least a second more rapid speed at which the apparatus is in a second nosed-up movement position in which it is at least partially raised relative to the immersed surface by means of pivoting about an axle, called a nosing-up axle, from said first movement position, by means of which the apparatus moves in said at least one movement direction in accordance with a second predetermined trajectory which is specific to said second nosed-up position and which is different from said first trajectory.

An apparatus according to the invention can therefore be controlled in at least three different trajectories, that is to say, said first and second predetermined trajectories in one first movement direction of the apparatus and at least one other trajectory, different from the first and second trajectories, in the other second movement direction of the apparatus, opposite said first movement direction.

Furthermore, there is nothing to prevent the provision of any number of different speeds in each movement direction of the apparatus, corresponding to a number of different movement positions (selected from a non-nosed-up movement position and movement positions which are nosed-up to a greater or lesser extent) of the apparatus, respectively, each movement position itself corresponding to a predetermined trajectory which is specific per se, that is to say, which is different from the trajectories brought about by the other movement positions of the apparatus. However, in, an advantageous embodiment according to the invention, each drive motor is reversible and said electric control unit is configured to control each drive motor in a first movement direction of the apparatus—in particular in a first rotation direction of the nosing-up axle when it is a drive axle driven by such a drive motor—in accordance with a single speed, and in a second movement direction of the apparatus—in particular in a second rotation direction of the nosing-up axle when it is a drive axle which is driven by such a drive motor—in accordance with a speed selected from at least two different speeds, including at least a first speed at which the apparatus moves into a first movement position and at least a second speed at which the apparatus moves into a second nosed-up movement position.

More specifically, advantageously and according to the invention, said electric control unit is configured to control each drive motor at least in the second movement direction of the apparatus—in particular in the second rotation direction of the nosing-up axle when it is a drive axle driven by such a drive motor—in accordance with a speed selected from two different speeds: a first slow speed and a second rapid speed.

In each movement position, the hollow body can be stabilized in terms of its angular position about the nosing-up axle using any appropriate means, in particular by means of dynamic balance, by at least one stop (which is in contact with the immersed surface or is integrated between the hollow body and the rotation shaft of the axle) limiting the pivoting involved in the nosing-up action, etc.

An apparatus according to the invention advantageously comprises at least one member for localized contact—in particular a runner or a small wheel—which is arranged so as to come into contact with the immersed surface in at least one position—in particular in at least one nosed-up movement position—of the apparatus so as to produce a gyration of the apparatus at one side.

Such a localized contact member is active (that is to say, in contact with the immersed surface) for at least one movement mode of the apparatus, that is to say, for at least one movement direction and/or for at least one position of the apparatus, for example when the apparatus is in a predetermined nosed-up movement position, and inactive (remote from the immersed surface or in any case arranged so as not to influence the trajectory of the apparatus) in the other movement modes of the apparatus, for example when the hollow body is in its normal operating movement position (cleaning the immersed surface).

Furthermore, such a localized contact member can be arranged to only locally brake the hollow body by means of friction contact with the immersed surface when it is in a predetermined nosed-up position, thereby producing a gyration at one side. This may be, for example, a runner or a small wheel which is blocked in terms of rotation. In a variant, such a localized contact member can be arranged to locally raise the hollow body, and disengage at least one guiding member of the nosing-up axle—in particular a motorized guiding and driving member—from the immersed surface, which guiding member is located close to this localized contact member. Furthermore, such a localized contact member can be arranged so as to be laterally offset relative to the nosing-up axle (relative to a median direction of the nosing-up axle) in order to produce local braking and/or disengagement of a guiding member—in particular a motorized guiding and driving member—and therefore a gyration of the apparatus at one side predetermined in this manner; or in contrast can be generally centered in a median direction of the nosing-up axle in order to produce disengagement of each guiding member—in particular each motorized guiding and driving member—the apparatus being driven in gyration at one side or the other (defined in a random manner) owing to inevitable operational imbalances resulting, for example, from the traction of the power supply cable.

Preferably, said guiding members of the apparatus comprise at least one non-driving member for guiding the hollow body relative to the immersed surface, each non-driving guiding member being offset in the movement orientation relative to the nosing-up axle (that is to say, not centered on the axis of this nosing-up axle). In each nosed-up movement position of the apparatus, at least one non-driving guiding member located in front of the nosing-up axle relative to the movement direction of the apparatus is disengaged from the immersed surface. Preferably, at said second more rapid speed corresponding to said second nosed-up position, each non-driving guiding member located in front of the nosing-up axle relative to said movement direction of the apparatus is raised and disengaged from the immersed surface.

Furthermore, several variants are possible with regard to the first movement position of the apparatus. In a first variant in accordance with the invention, said electric control unit is configured to control each drive motor at said first speed so that said first movement position corresponds to a normal non-nosed-up movement position of the apparatus in which each guiding member is in contact with the immersed surface.

In a second variant according to the invention, said electric control unit is configured to control each drive motor at said first speed so that said first movement position also corresponds to a nosed-up movement position in which the apparatus is at least partially raised relative to the immersed surface by means of pivoting about the nosing-up axle from a non-nosed-up movement position (normal movement position, in particular for which all the guiding members are in contact with the immersed surface, the rolling plane defined by these guiding members being aligned with the immersed surface), the apparatus being less nosed-up in said first nosed-up movement position than in said second nosed-up movement position.

Furthermore, the different trajectories corresponding to the different movement positions of the apparatus can be obtained by various means: by means of hydraulic resistances which are different from one movement position to the other and which are asymmetrical in at least one movement position or in some movement positions, in order to produce a gyration of the apparatus. Advantageously, an apparatus according to the second above-mentioned variant of the invention comprises a first localized contact member—in particular a first runner or a first small wheel—which is laterally offset relative to the nosing-up axle and which is arranged so as to come into contact with the immersed surface in said first movement position (nosed-up or non-nosed-up) in order to produce a gyration of the apparatus at one side.

Furthermore, an apparatus according to an embodiment of the invention advantageously comprises a localized contact member, called a second localized contact member, which is laterally offset relative to the nosing-up axle and arranged so as to come into contact with the immersed surface in said second nosed-up movement position so as to produce a gyration of the apparatus at one side. This second localized contact member can be formed by a runner or a small wheel or the like.

Furthermore, advantageously and according to the invention, said first localized contact member is arranged so as to come into contact with the immersed surface only in said first movement position (nosed-up or non-nosed-up), said second localized contact member is arranged so as to come into contact with the immersed surface only in said second nosed-up movement position, and the second localized contact member is laterally offset relative to the nosing-up axle opposite the first localized contact member so that, in said second nosed-up movement position, the apparatus is driven in gyration at the side opposite that towards which it is driven in gyration in said first movement position (nosed-up or non-nosed-up). Advantageously and according to the invention, at least one localized contact member is arranged so as to come into contact with the immersed surface at the rear of the nosing-up axle relative to the movement direction of the apparatus.

Furthermore, an apparatus according to the invention advantageously comprises a device for pumping the liquid between each liquid inlet and each liquid outlet, this pumping device being active at least when the apparatus is moving in one direction, called a forward direction, for cleaning the immersed surface, the liquid being pumped, with any debris being carried therewith, in the hydraulic circuit and through the filtering device from each liquid inlet located at the base of the hollow body opposite the immersed surface.

The pivoting of the apparatus and its control in each nosing-up movement position can be obtained using different means. In particular, this pivoting may result from a torque generated by inertia during an acceleration of each guiding driving member (in the embodiments in which the nosing-up axle is a drive axle comprising at least one such motorized guiding and driving member) and/or by means of a hydraulic reaction generated by at least one secondary liquid outlet out of the hollow body for at least one drive direction of the pumping device, the orientation and/or the amplitude of said hydraulic reaction being configured to at least participate in placing the apparatus in a nosing-up movement position and/or increasing the nosing-up action of the apparatus.

In a preferred embodiment, an apparatus according to the invention is characterized in that the guiding members comprise at least one non-driving member for guiding the hollow body relative to the immersed surface, each non-driving guiding member being offset in the movement direction relative to the nosing-up axle (that is to say, not centered on the axis of the nosing-up axle), and the nosing-up axle is a front axle, each non-driving guiding member being arranged towards the rear relative to the front nosing-up axle, and in that said electric control unit is configured to control each mechanical drive motor:

- in a first rotation direction of the drive shaft for which the apparatus is moving forwards relative to the immersed surface and, regardless of the speed thereof, in a normal non-nosed-up movement position in which all the guiding members are in contact with the immersed surface,
- in a second rotation direction of the drive shaft for which the apparatus is moving backwards relative to the immersed surface and, depending in its speed, in a movement position selected from a first movement position and a second nosed-up movement position. More specifically, advantageously and according to the invention, said electric control unit is configured to control each drive motor in a forward direction at a predetermined speed, and in a backward direction at a speed selected from the first slow speed at which the apparatus is in a first movement position and the second rapid speed at which the apparatus is in a second nosed-up movement position.

More specifically, the pumping device of an apparatus according to the invention preferably comprises:

- at least one axial pumping propeller with a unidirectional pitch which creates a flux of liquid which is generally orientated along the rotation axis thereof, and which is inserted in said hydraulic circuit,
- at least one reversible electric pumping motor which is carried by said hollow body and which comprises a drive shaft which is mechanically connected to each pumping propeller to drive it in rotation, and wherein at least one of said at least one pumping propeller is arranged so as to generate:
  - in a first rotation direction, a flow of liquid in the hydraulic circuit which is discharged via at least one outlet, called a main liquid outlet,
  - in a second rotation direction, a flow of liquid in the hydraulic circuit in a backward direction from each main outlet, which flow is discharged via at least one other liquid outlet, called a secondary outlet, which is arranged so as to orientate the current of liquid which is discharged via this secondary outlet so that this current creates reaction forces whose resultant, called a secondary hydraulic reaction force, has a component for driving the apparatus in a backward direction parallel with the rolling plane which is not equal to zero, called a horizontal component, and a nosing-up torque of the apparatus about the nosing-up axle.

In this manner, advantageously and according to the invention, said control unit is connected to the pumping device in order to control it so that, when each drive motor is controlled in one direction and in accordance with a speed corresponding to a nosed-up position, the pumping device generates a flux of liquid which produces, as it is discharged from the hollow body, a hydraulic reaction, called a hydraulic nosing-up reaction, whose orientation does not intersect with the axis of the nosing-up axle and is orientated in the correct direction in order to at least participate in the nosing-up action of the hollow body about the nosing-up axle. Preferably and according to the invention, the pumping device is reversible so as to be able to generate a flow of liquid in a backward direction from at least one main liquid outlet, towards at least one secondary liquid outlet, and the hydraulic nosing-up reaction is produced when the pumping device is controlled by the electric control unit in a backward direction.

Furthermore, the driving of an apparatus according to the invention can be obtained equally well in a mechanical manner by at least one electric drive motor which is connected to at least one motorized guiding and driving member and/or in an at least partially hydraulic manner by at least one hydraulic electric drive motor which generates a hydraulic flux which is discharged from the apparatus with a horizontal component (parallel with the rolling plane and the immersed surface) in at least one drive direction, or even in a completely hydraulic manner in one drive direction or in two different drive directions.

Advantageously and according to embodiments in accordance with the invention, said main outlet is arranged so as to orientate the current of liquid which is discharged via this main outlet so that this current creates reaction forces whose resultant, called a main hydraulic reaction force, has a non-zero component for driving the apparatus in a forward direction parallel with the rolling plane, called a horizontal component. In this manner, this horizontal component is involved in driving the apparatus in the first rotation direction of the motor, the apparatus being driven at least partially in a hydraulic manner. In some possible embodiments of the invention, the driving of the apparatus can be obtained only by this horizontal component, in a hydraulic manner, from the drive motor which is coupled to each axial pumping propeller—in particular to a single axial pumping propeller—of the apparatus.

In some embodiments, the invention more specifically relates to an apparatus for cleaning a surface which is immersed in a liquid, comprising:

a hollow body, members for guiding said hollow body over the immersed surface, comprising a single drive axle which is provided with at least one rolling driving member, called a motorized member, which is rotatably driven, a filtration chamber provided in said hollow body and having:

at least one liquid inlet into the hollow body, at least one liquid outlet out of the hollow body, a hydraulic circuit for circulation of liquid between each liquid inlet and each liquid outlet through a filtering device, at least one electric drive motor, called a mechanical drive motor, which is carried by said hollow body and which comprises a drive shaft which is mechanically connected to the drive axle in order to drive each motorized member thereof, an electric control unit which is connected to each mechanical drive motor in order to supply it with electrical power and to control it in at least one rotation direction of the drive shaft, said electric control unit being configured to control each mechanical drive motor in at least one rotation direction of the drive shaft which corresponds to a movement direction of the apparatus and in which each motorized member is driven in one direction and at a speed selected from:

at least a first speed at which the apparatus is in a first movement position relative to the immersed surface and moves in said movement direction in accordance with a first predetermined trajectory, at least a second more rapid speed at which the apparatus is in a second nosed-up movement position in which it is at least partially raised relative to the immersed surface by means of pivoting about the drive axle, which constitutes a drive nosing-up axle, from said first movement position, by means of which the apparatus moves in said movement direction in accordance with a second predetermined trajectory specific to said second nosed-up movement position and different from said first trajectory.

Advantageously, an apparatus according to preferred embodiments of the invention comprises a single reversible electric motor which is carried by said hollow body (this single electric motor therefore being a driving and pumping motor), this motor comprising a drive shaft which is simultaneously mechanically connected to:

at least one of said guiding members, called a motorized member, of the nosing-up drive axle, in order to move it, each pumping propeller, in order to move it.

In these preferred embodiments, advantageously and according to the invention, the electric control unit is configured to control the electric motor:

in a first rotation direction which corresponds to the forward movement direction of the apparatus and to the normal rotation direction of each pumping propeller which generates a flux of liquid between each liquid inlet (located at the base of the hollow body opposite the immersed surface) and each main liquid outlet (offset in an upward direction, and preferably towards the rear relative to each liquid inlet), in a second rotation direction which corresponds to the backward movement direction of the apparatus and to the reverse rotation direction of each pumping propeller which generates a flux of liquid in a backward direction which produces, via at least one outlet of the hollow body, a hydraulic reaction, which does not intersect with the axis of the nosing-up drive axle and which is orientated so as to generate a nosing-up torque of the hollow body about the nosing-up drive axle.

The different periods of time for controlling the apparatus in the different trajectories can be predetermined or defined in a random manner and can be optimized, for example in accordance with the application.

Advantageously and according to the invention, said electric control unit is configured to control each drive motor principally in a forward direction, and to control each drive motor from time to time in the backward direction in accordance with the first speed and from time to time in a backward direction in accordance with the second speed.

Advantageously and according to the invention, said electric control unit is configured to control at least one predetermined period of operating time for each drive motor in one direction and at one speed.

Advantageously and according to the invention, said electric control unit is configured to control in a random manner at least one period of operating time for each drive motor in one direction and at one speed.

The invention also relates to an apparatus characterized in combination by all or some of the features mentioned above or below.

Figure 4:
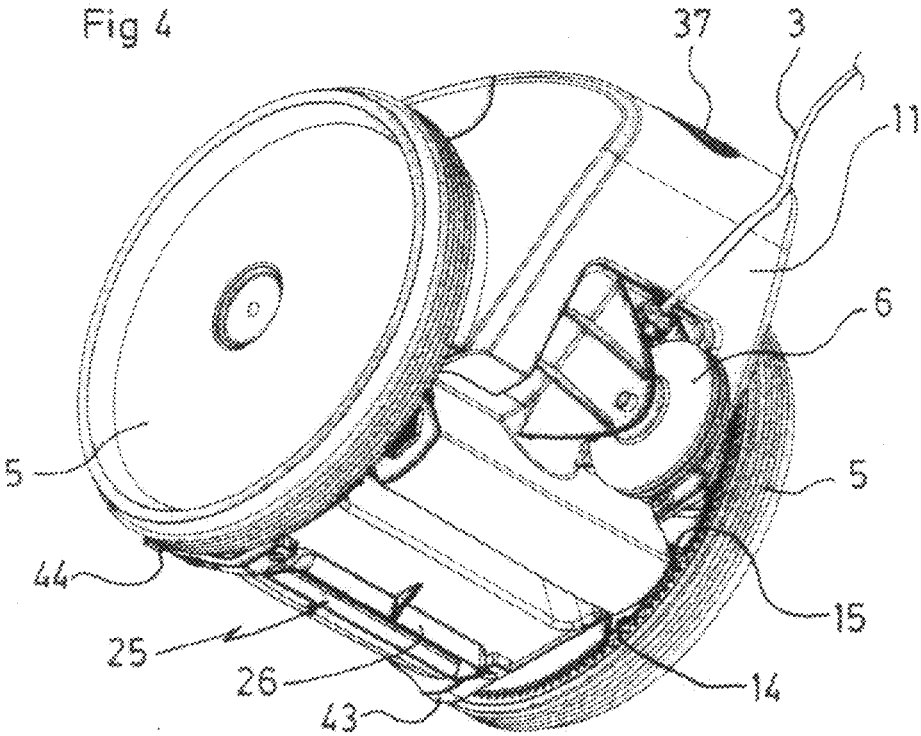
Figure 6:
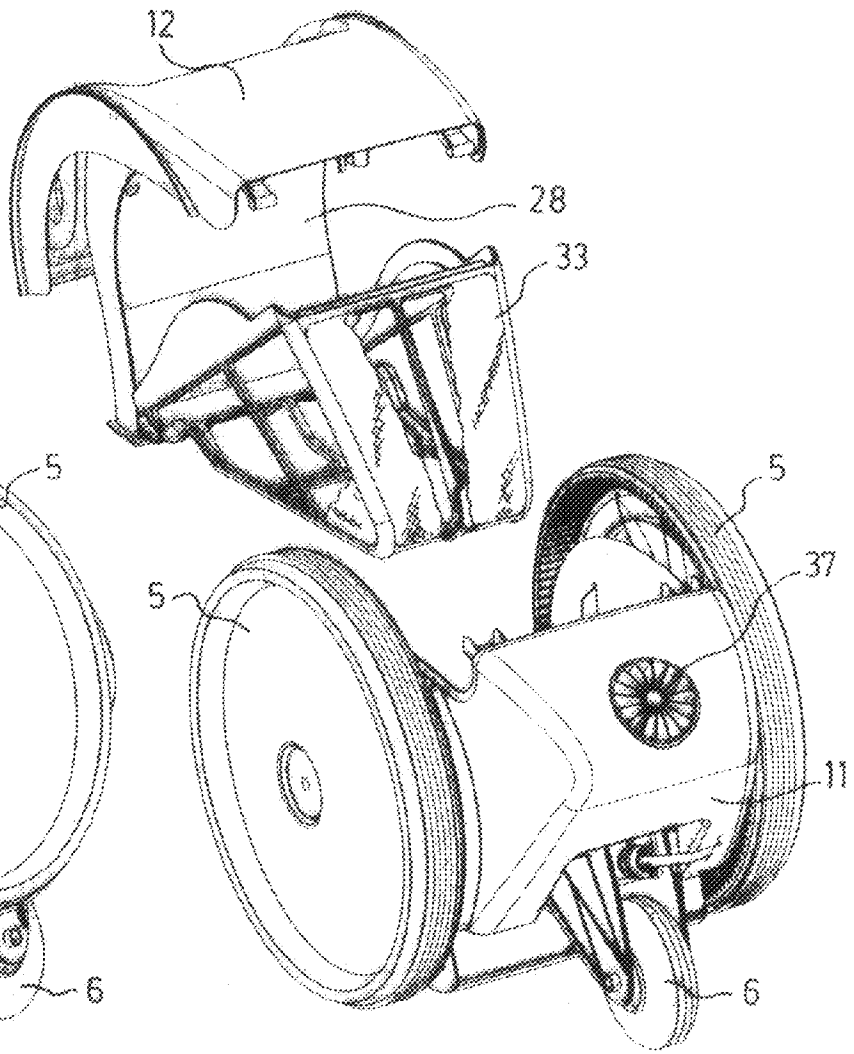
Figure 5:
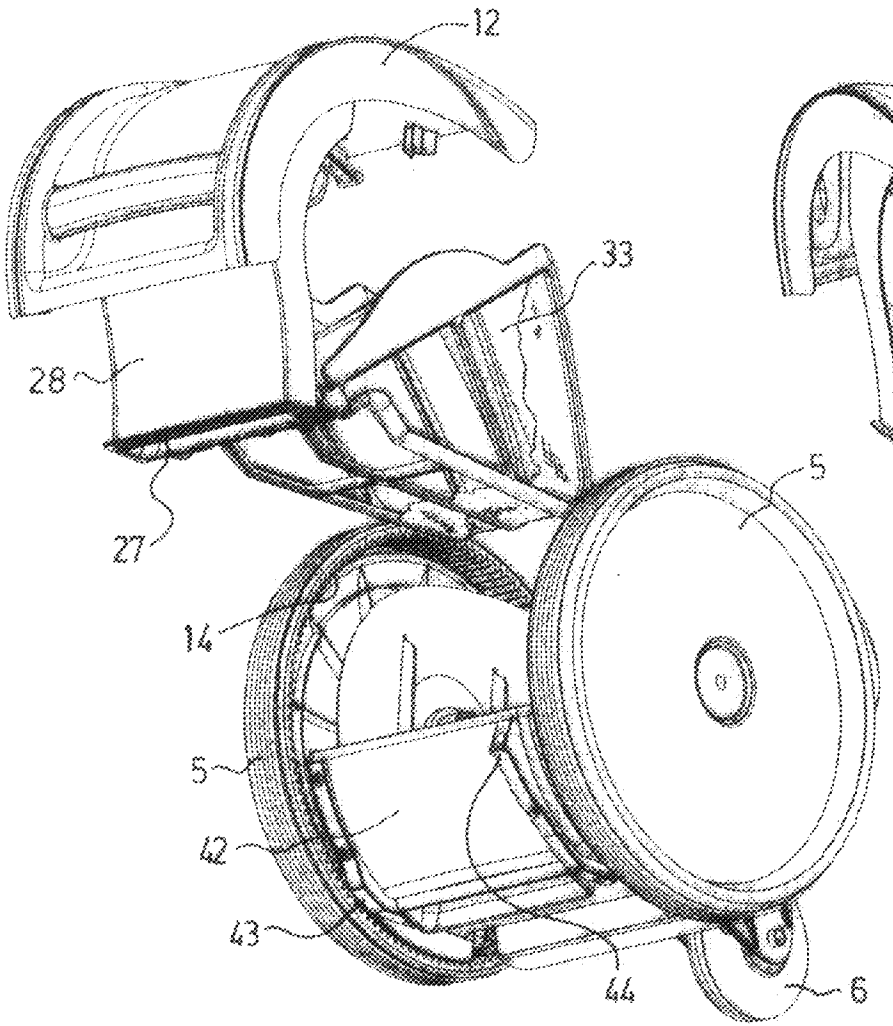
Figure 7:
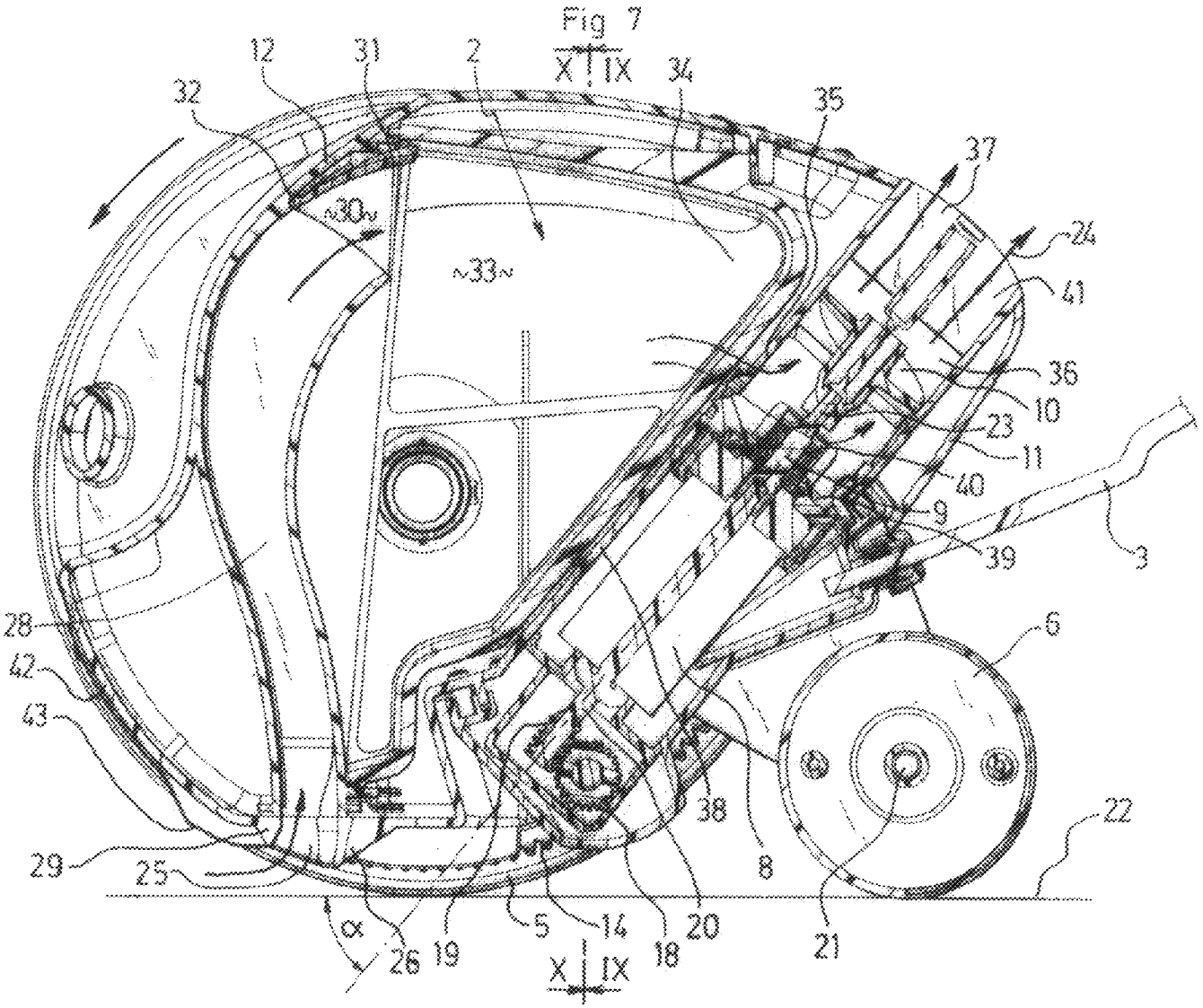
Figure 8:
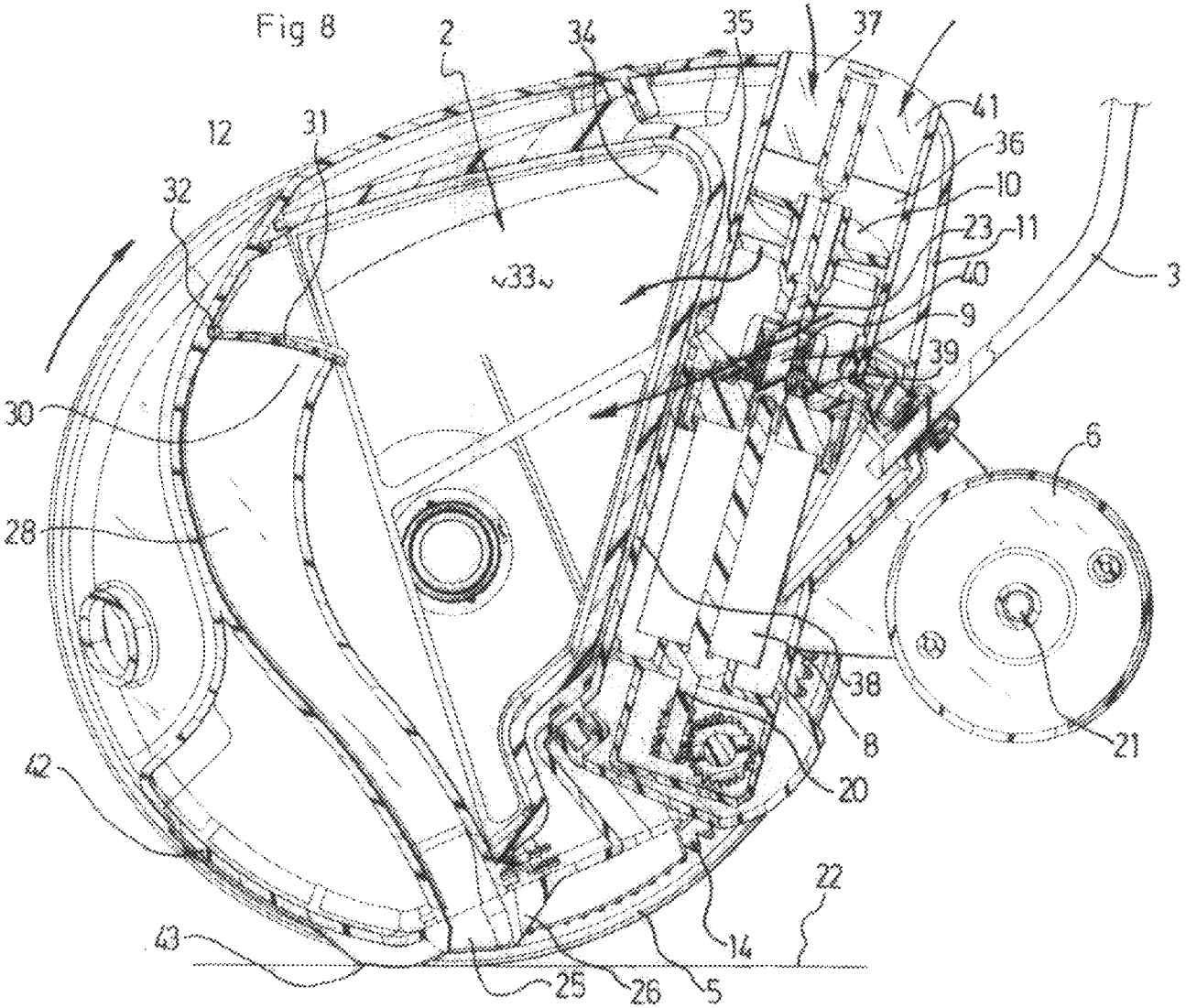
Figure 9:
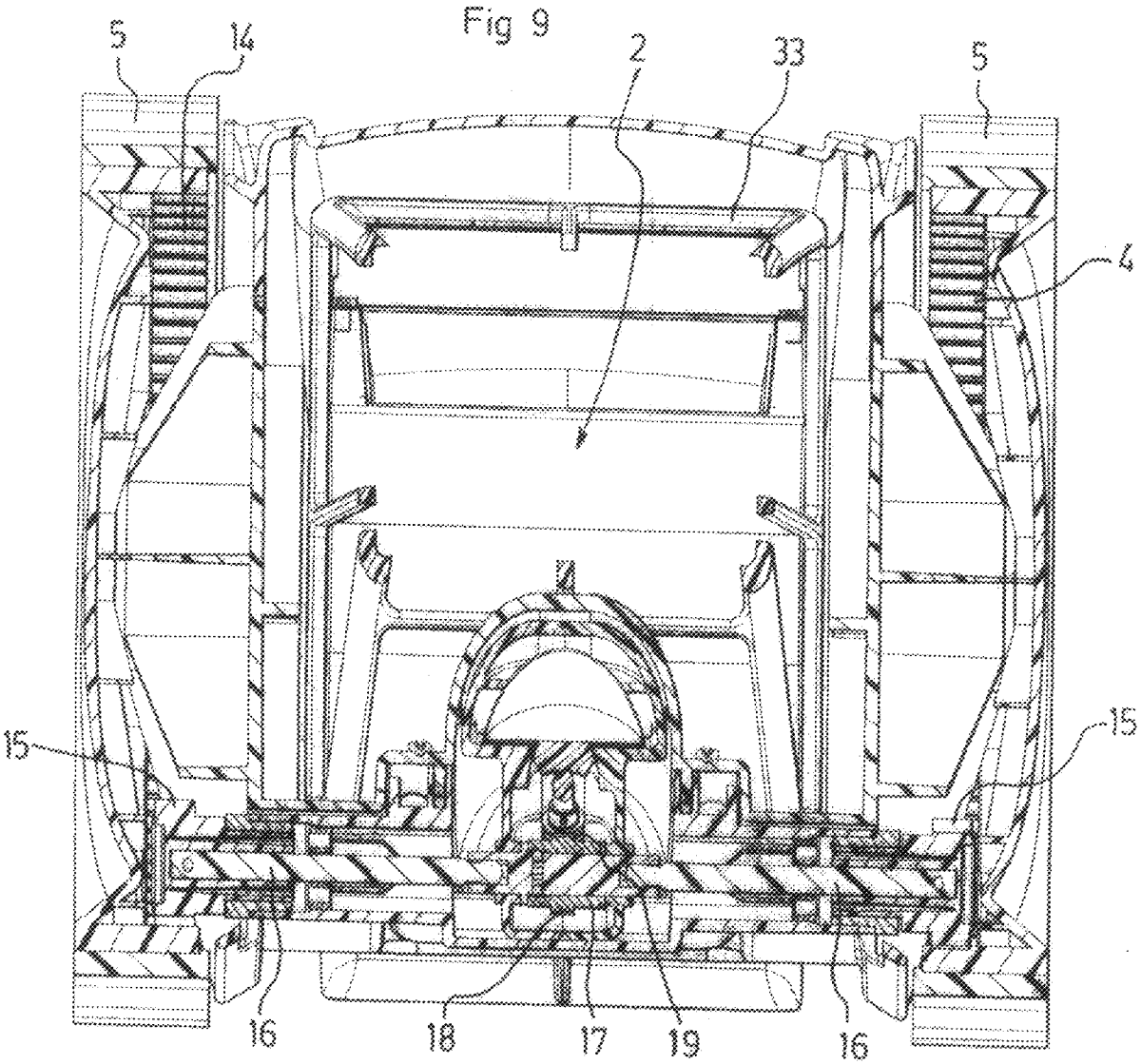
Figure 10:
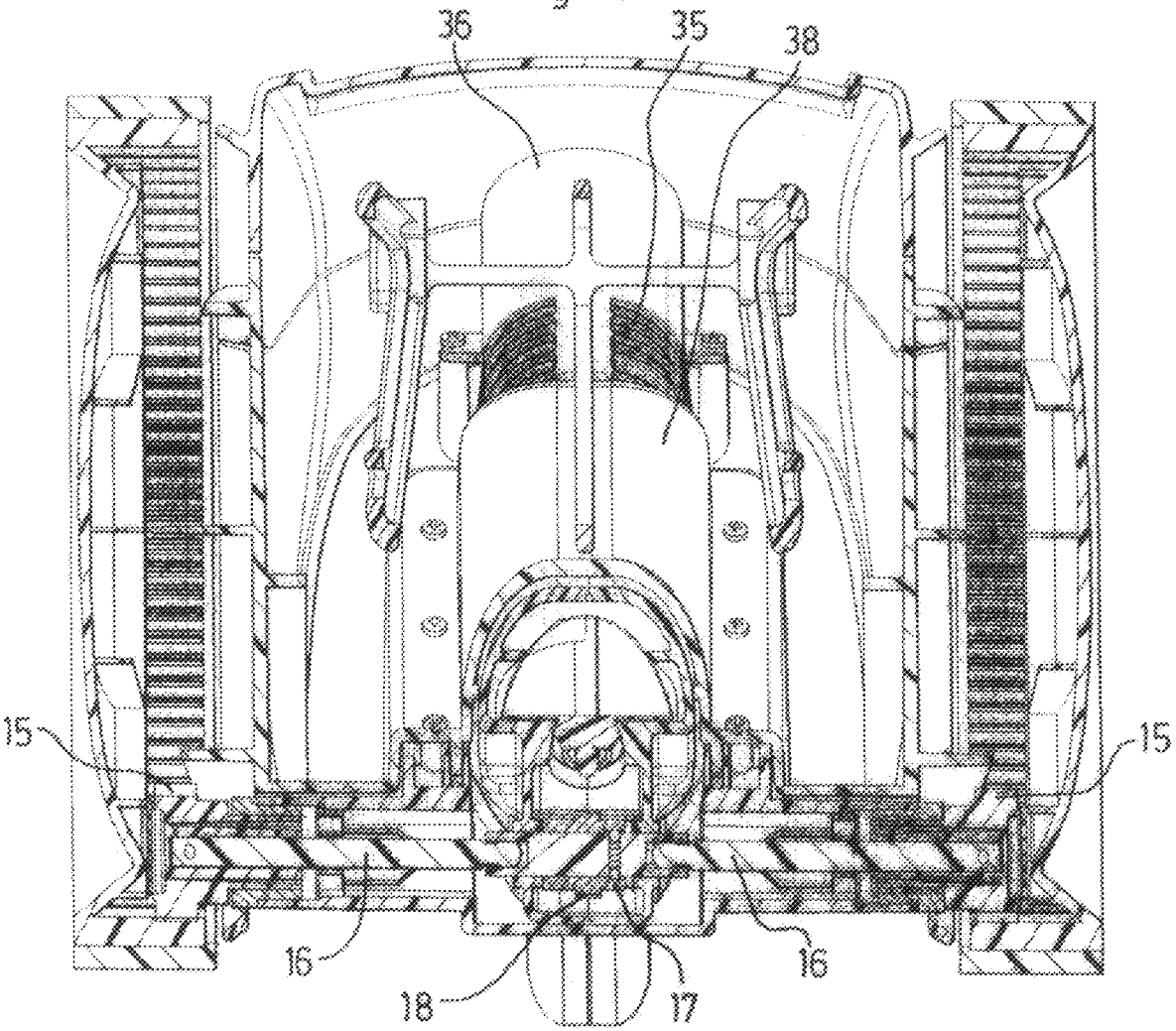
Figure 11C:
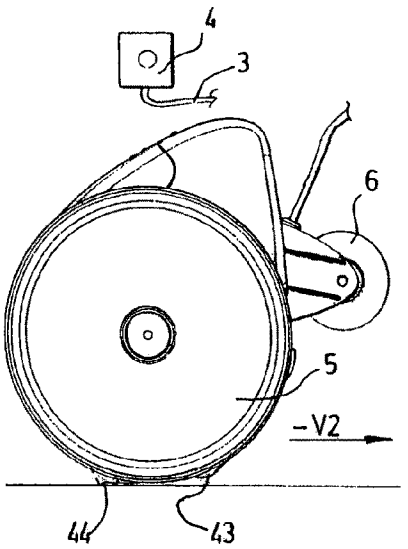
Figure 11B:
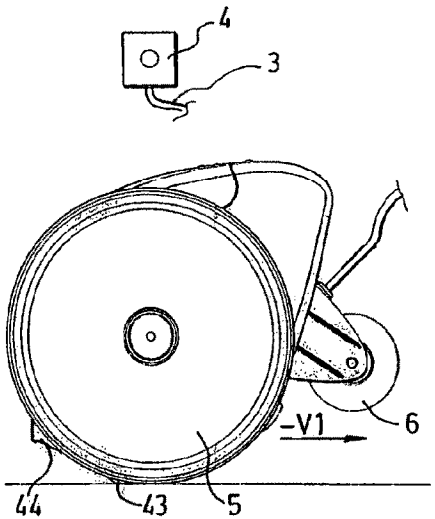
Figure 11A:
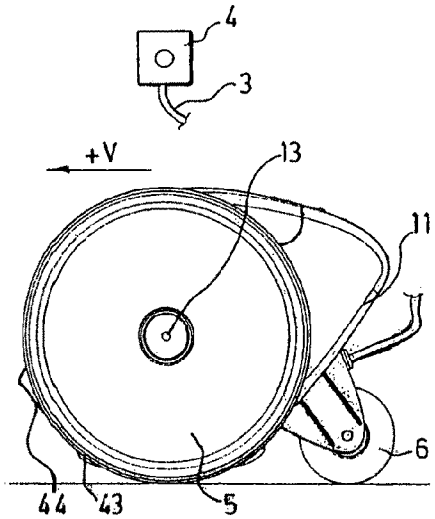
Figure 12C:
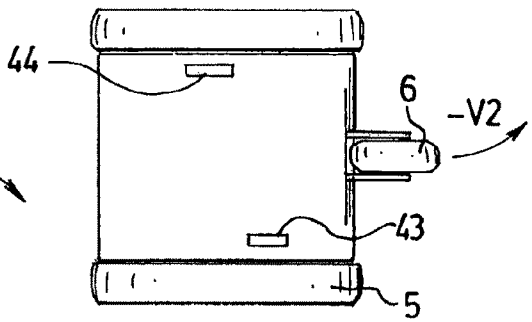
Figure 12B:
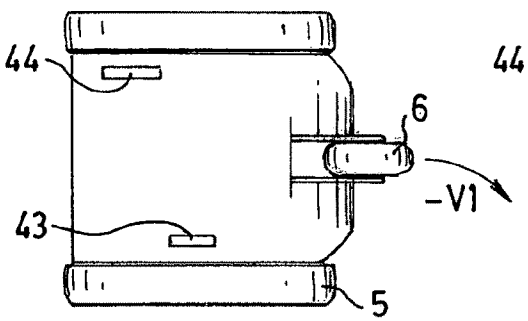
Figure 12A:
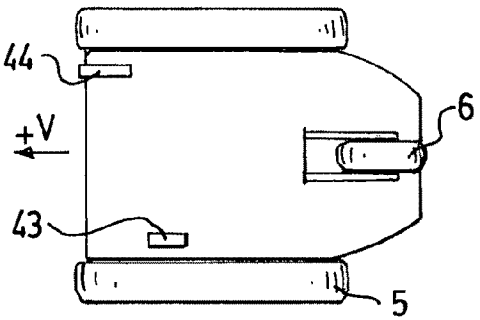
Figure 13:
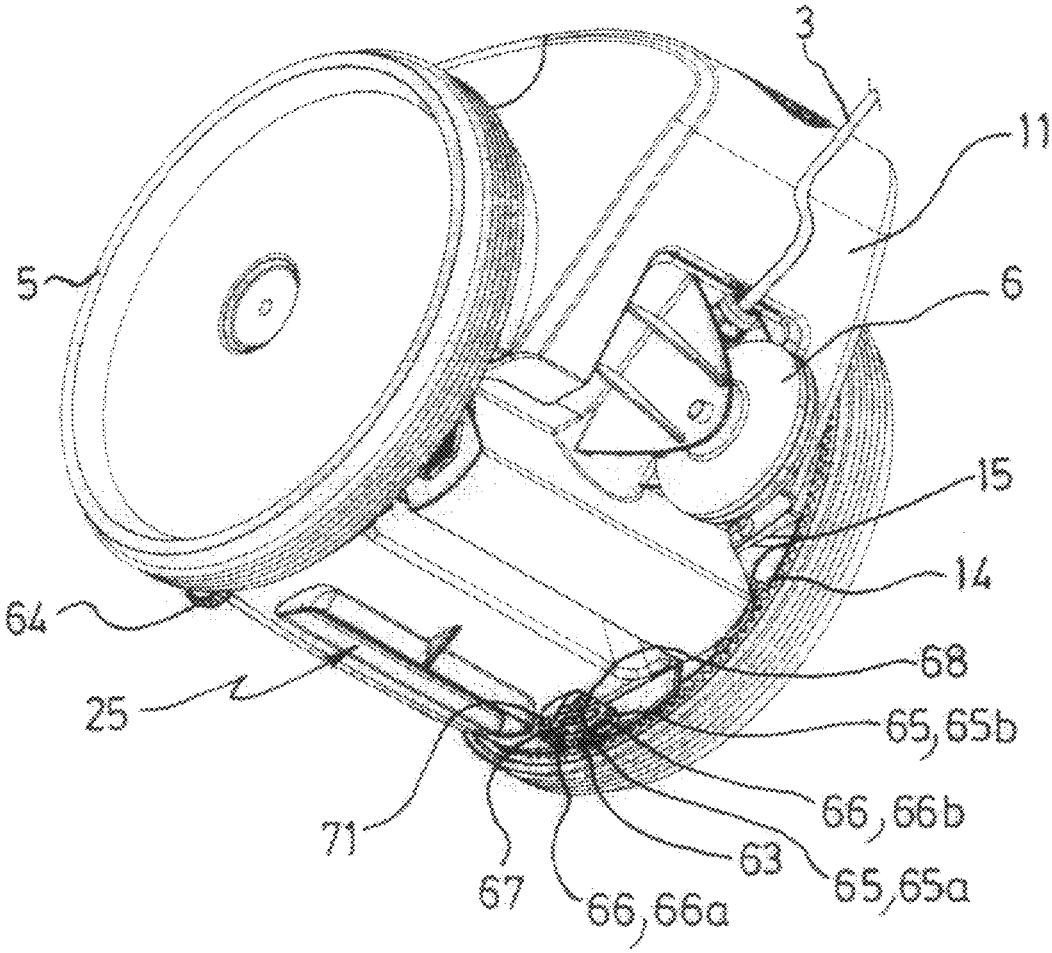
Figure 14:
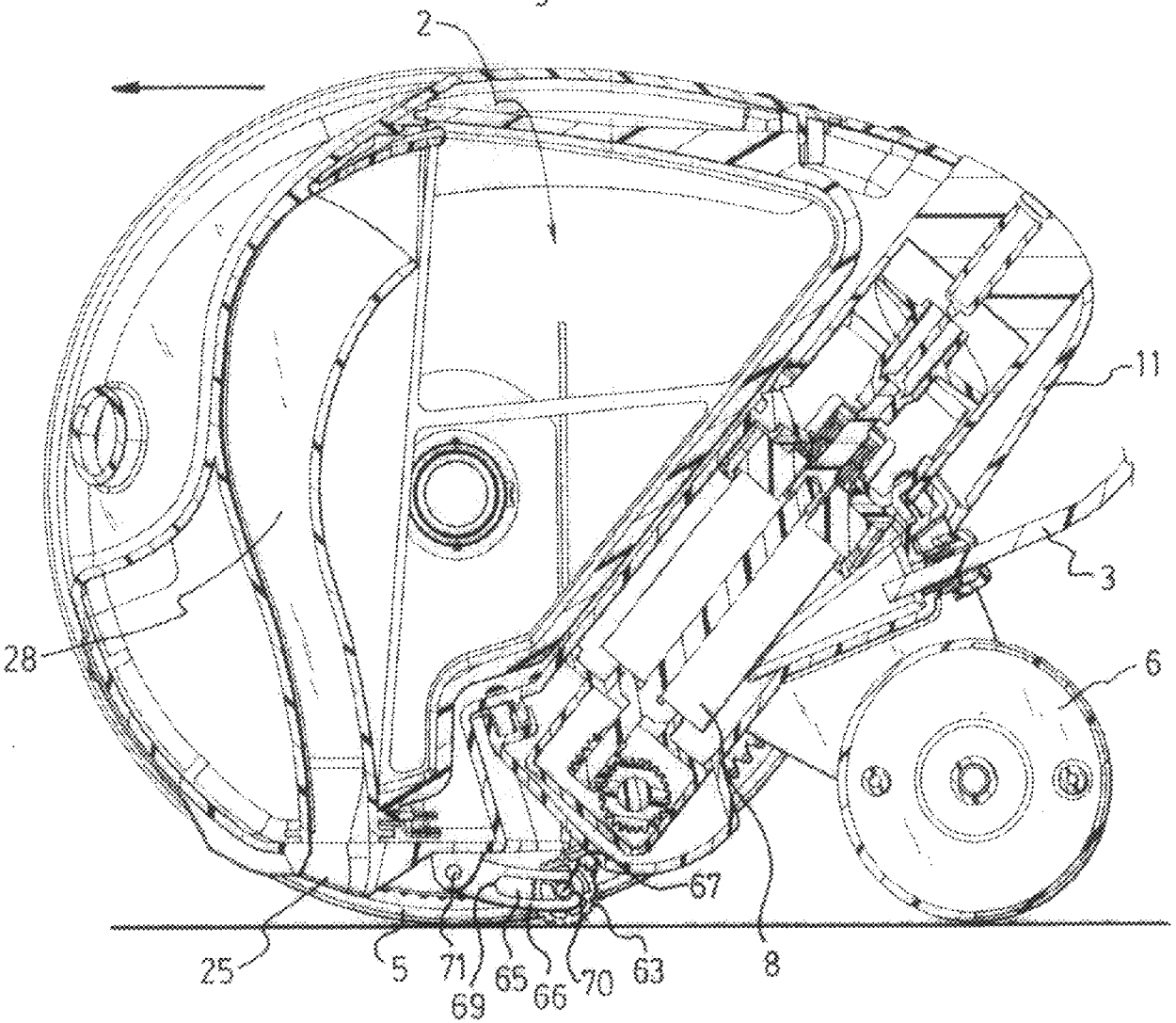
Figure 15:
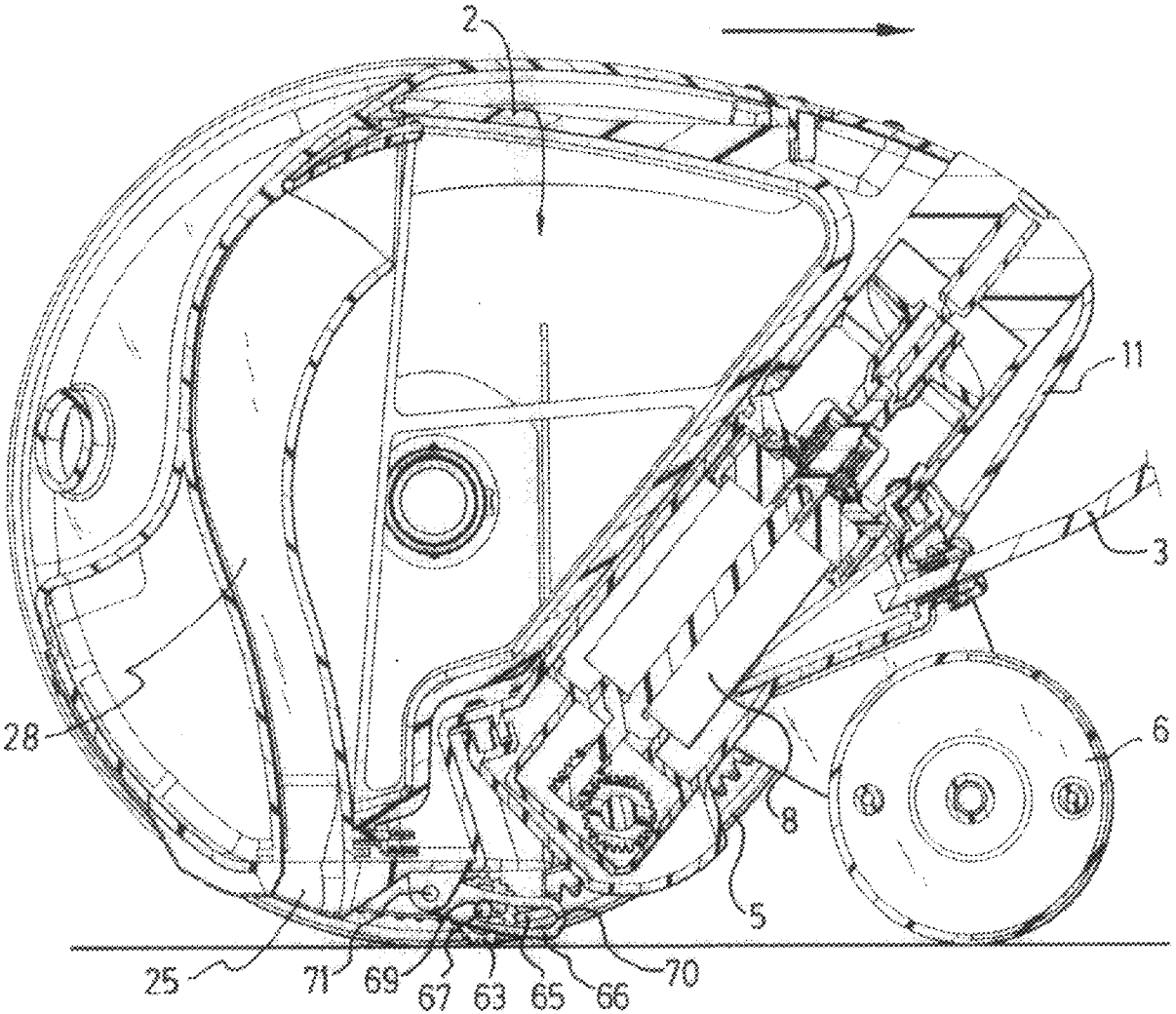
Figure 16:
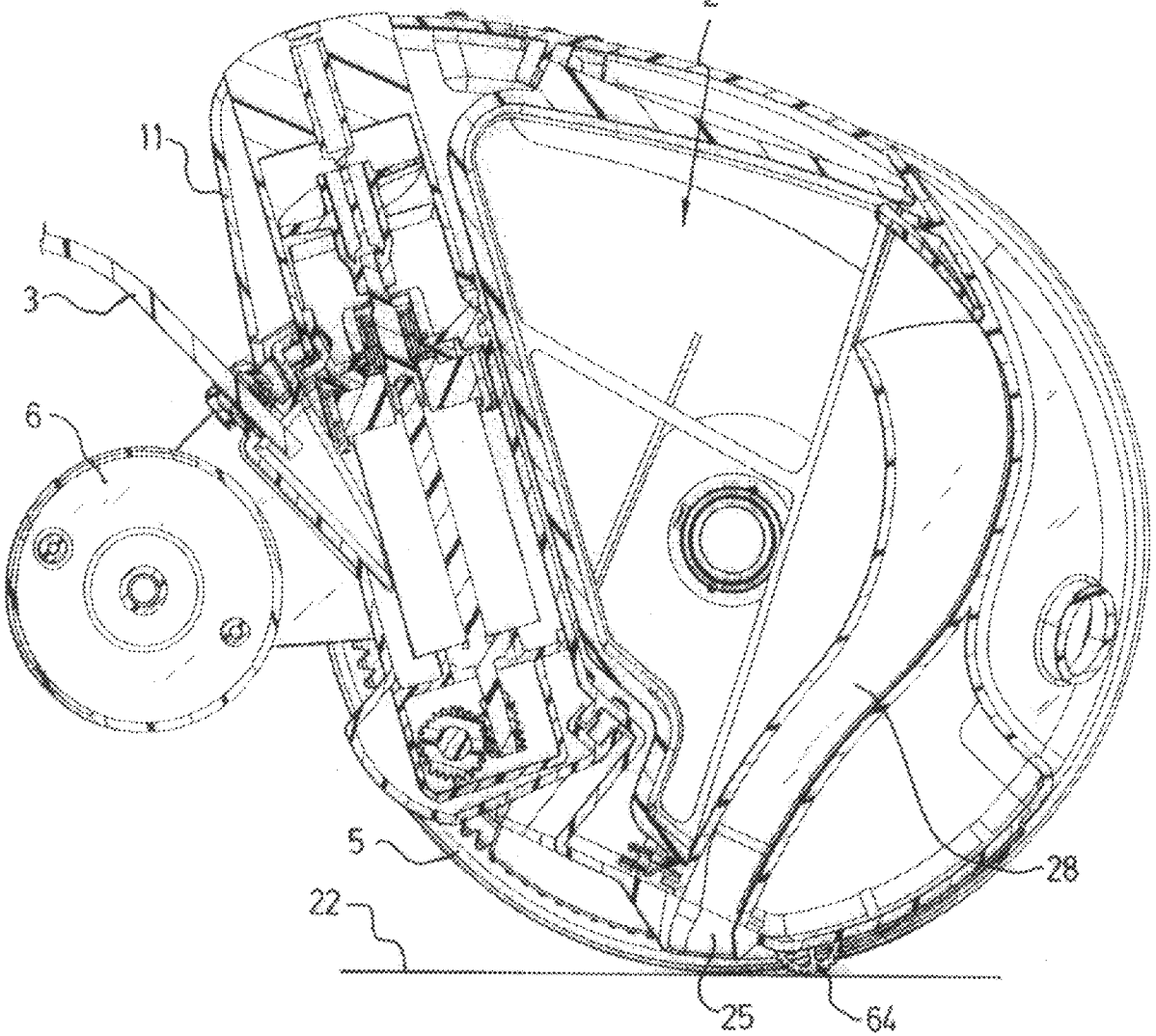

Other objects, features and advantages of the invention will be appreciated from a reading of the following description, which is given by way of non-limiting example and with reference to the appended Figures, in which:

FIGS. 1 to 4 are schematic perspective views from different angles (three-quarter upper front, three-quarter upper rear, three-quarter lower front and three-quarter lower rear, respectively) of an apparatus according to a first embodiment of the invention, FIGS. 5 and 6 are exploded schematic perspective views from two different angles (three-quarter lower front and three-quarter upper rear, respectively) of the apparatus of FIGS. 1 to 4, FIG. 7 is a schematic section through a longitudinal vertical plane along line VII-VII of FIG. 1, illustrating the apparatus according to the first embodiment of the invention driven in the normal forward cleaning movement direction, FIG. 8 is a schematic section along line VII-VII of FIG. 1, illustrating the apparatus according to the first embodiment of the invention driven in a backward movement direction in a nosed-up movement position, FIG. 9 is a schematic section towards the rear along line IX-IX of FIG. 7, FIG. 10 is a schematic section towards the front along line X-X of FIG. 7, FIGS. 11*a* to 11*c* are schematic profile views of the apparatus of FIGS. 1 to 4, in a normal movement position, in a first nosed-up movement position and in a second nosed-up movement position, respectively, FIGS. 12*a* to 12*c* are schematic bottom views of FIGS. 11*a* to 11*c*, in a normal movement position, in a first nosed-up movement position and in a second nosed-up movement position, respectively, FIG. 13 is a perspective bottom view similar to FIG. 4 but illustrating a second embodiment of the invention, FIG. 14 is a view similar to FIG. 7 illustrating the apparatus according to the second embodiment of the invention driven in the normal cleaning movement direction, FIG. 15 is a view similar to FIG. 7 illustrating the apparatus driven in a backward movement direction at a first speed corresponding to a normal movement position, FIG. 16 is a schematic section in a longitudinal vertical plane at the side opposite FIG. 14 and illustrating the apparatus in accordance with the second embodiment of the invention driven in a backward movement direction in a nosed-up movement position.

The apparatus according to the embodiments of the invention illustrated in the Figures is a self-propelling apparatus of the electrical type for cleaning an immersed surface, that is to say, is connected only by an electric cable 3 to a control unit 4 located out of the liquid. All along the text, unless indicated otherwise, the apparatus is described with a movement position over an immersed surface (inclination in a plane which contains the movement direction and which is orthogonal with respect to the immersed surface) which is assumed to be horizontal. Of course, the apparatus according to the invention can move equally well on non-horizontal surfaces, in particular inclined or vertical surfaces.

This apparatus comprises a hollow body 1 which is formed by different walls of rigid synthetic material which are fitted to each other which, on the one hand, allows a filtration chamber 2 to be delimited and which, on the other hand, allows a chassis to be formed which receives and carries guiding and driving members 5, 6, a single electric motor 8 which has a drive shaft 9, a mechanical transmission between the drive shaft 9 of the electric motor 8 and at least one guiding and driving member, called a motorized member 5, and an axial pumping propeller 10.

In the embodiments illustrated, the hollow body 1 has a rear lower shell 11 which forms a chassis, supplemented by a front upper cover 12 which can be removed from the shell 11. The cover 12 is provided with a front transverse handle 47 which allows the apparatus to be handled and transported.

The shell 11 has two large lateral front drive wheels 5 which are coaxial and which have the same diameter. The drive wheels 5 have the largest diameter possible which does not increase the vertical spatial requirement of the apparatus. That is to say, the diameter of the front wheels 5 corresponds at least to the overall height (dimension in the orientation normal with respect to the rolling plane 22 on the immersed surface) of the apparatus according to the invention. For example, the diameter of the front wheels 5 is between 250 mm and 300 mm, in particular in the order of 275 mm.

These large wheels 5 have been found to have significant and unexpected advantages. First of all, they prevent any untimely contact of a protruding portion of the hollow body on the immersed surface and thus allow this immersed surface to be protected to some degree during the operation of the apparatus. In turn, they provide a degree of protection for the hollow body itself with respect to impacts from external objects which only come into contact with the large wheels 5. They also ensure improved traction of the apparatus using the same electric motor. They are further particularly advantageous in the context of an apparatus which has at least one nosed-up movement position in at least one drive direction in so far as they considerably facilitate this nosing-up action. They limit the risks of blockage on the irregularities (in particular hollows and/or reliefs) of the small immersed surface and have multiple contact zones with different orientations (top, front, bottom) with the immersed surface. By providing particularly efficient and effective guiding and driving, they allow the performance levels and features of the other required guiding members to be reduced (simple small wheel 6 in the examples illustrated), even allow them to be dispensed with (variant which is not illustrated). They also allow a transmission to be produced which is as direct as possible (without any intermediate gear stage) between the drive shaft and each wheel 5 which can be provided, to this end, with an internal toothed crown which is provided with a plurality of teeth and which produces a large step-down action in a single stage. They are particularly advantageous in combination with a motor 8 having an inclined axis as described below.

The front wheels 5 are coupled via a mechanical transmission to the drive shaft 9 of the electric motor 8 and are therefore rotatably driven thereby. They thus form a front drive axle 7. Each front wheel 5 is guided in rotation on the shell 11 about a transverse axis 13 which defines the axis of the front axle 7. Each front wheel 5 has an internal toothed crown 14 allowing to receive a pinion 15 which is mounted at the end of a half-drive-shaft 16 which is coupled to a central bridge 17 comprising a pinion 18 which is rotatably driven by an endless screw 19 at a front lower end 20 of the drive shaft 9. In this manner, when the drive shaft 9 is rotatably driven in one direction by the motor 8, the pinion 18 is rotatably driven in one direction, and each pinion 15 is also rotatably driven in one direction, which drives the corresponding front wheel 5 in one direction. When the drive shaft 9 is rotatably driven in the other direction, the pinions 18 and 15 are rotatably driven in the other direction, as are the front wheels 5. In this manner, the motor 8 allows the front drive wheels 5 to be driven in one or other of the two rotation directions, forwards and backwards.

The shell 11 also carries a small rear wheel 6 which can freely rotate (non-driving wheel) about a transverse axis 21. This small wheel 6 constitutes a rolling guiding member which, in the example illustrated, is not a driving member, that is to say, does not carry out the driving function and is not steering, that is to say, its axis 21 is fixed and parallel with the axis 13 of the drive shaft 5. The two front wheels 5 and the small rear wheel 6 define the same plane, called a rolling plane 22, which corresponds to the immersed surface when the apparatus is carrying out a normal cleaning movement thereon, all the wheels 5, 6 being in contact with the immersed surface.

The single electric motor 8 acts not only as a drive motor for the drive wheels 5 but also as a pumping motor which drives the propeller 10 in rotation about the axis thereof. To this end, the drive shaft 9 of the motor 8 extends longitudinally through the body of the motor and opens axially so as to protrude from both sides of the body of the motor, that is to say, with a front lower end 20 which drives the wheels 5 as indicated above, and with a rear upper end 23 to which the pumping propeller 10 is directly coupled so as to be fixedly joined in rotation.

The shell 11 carries the electric motor 8 in an inclined position relative to the rolling plane 22, that is to say, with the drive shaft 9 (which opens axially at the two sides of the body of the motor) inclined through an angle a which is not 0° or 90° relative to the rolling plane 22. In particular, the drive shaft 9 is not orthogonal relative to the rolling plane 22. The angle a of inclination is between 30° and 75°, for example in the order of 50°. The angle a is also the inclination angle of the axis of the propeller 10 and the orientation 24 of the hydraulic flux generated thereby. The angle a also corresponds to the general orientation of the hydraulic reaction generated by the flux of liquid at the outlet 37 in a normal pumping direction and towards the filter 33 in a backward direction.

Such an inclination has a number of advantages, and in particular allows a great compactness to be conferred on the apparatus according to the invention and allows the force of the hydraulic reaction resulting from the liquid flow generated by the propeller 10, in particular its component parallel with the rolling plane 22, to be used for driving the apparatus in a normal movement direction.

The shell 11 also has a lower opening 25 which extends transversely substantially over the entire width and which is slightly offset towards the front relative to the vertical transverse plane (orthogonal relative to the rolling plane 22) which contains the axis 13 of the drive axle 7. This opening 25 forms a liquid inlet at the base of the hollow body in the normal pumping direction for cleaning the immersed surface.

This opening 25 preferably has a flap 26 which extends along the rear edge thereof and at the sides in order to facilitate the suction of the debris. The opening 25 preferably also has a rib 29 which extends along its front edge, protruding downwards, in order to create a turbulence effect at the rear of this rib 29 which tends to disengage the debris from the immersed surface and accelerate the flux of liquid entering the opening 25.

The opening 25 is adapted to receive a lower end 27 of an inlet conduit 28 which is integral with the cover 12. The assembly constitutes a liquid inlet at the base of the hollow body 1, via which the liquid is drawn in by the suction resulting from the pumping propeller 10 when it is driven in a normal pumping direction by the motor 8.

The conduit 28 generally extends over the entire width of the cover 12 and upwards (substantially orthogonally with respect to the rolling plane 22) as far as an upper opening 30 which is provided with a pivoting shutter 31 which acts as a valve. The shutter 31 is articulated about a horizontal transverse axis 32 located at the front of the opening 30. The cover 12 is arranged to be able to receive and carry a filter 33 which extends at the rear of the conduit 28 so as to receive the liquid flow (loaded with debris) from the upper opening 30 of the inlet conduit 28.

This filter 33 is formed by rigid filtering walls and is in liquid communication at the upper rear portion 34 thereof with an inlet 35 of a conduit 36 which receives the axial pumping propeller 10, this conduit 36 generally extending in the pumping orientation 24 of the liquid, in the continuation towards the rear and towards the top of the drive shaft 9, as far as an outlet 37 for liquid out of the hollow body 1 via which the liquid is generally discharged in the orientation 24 when the propeller 10 is driven by the motor 8 in the normal pumping direction. The path of liquid in the normal pumping direction in the hydraulic circuit for liquid flow thus formed between the liquid inlet 25 and the liquid outlet 37 through the filter 33 is illustrated schematically by arrows in FIG. 7. The shutter 31 which acts as a valve is located in the region of the inlet of the filter 33 which is aligned with the upper opening 30 of the inlet conduit 28. In a variant which is not illustrated, such a valve, whose function is to prevent, in a backward direction, any backflow of liquid out of the hollow body via the inlet 25 could be incorporated within the inlet conduit 28 itself.

The motor 8 is carried below an inclined fluid-tight lower wall 38 of the shell 11 which delimits the filtration chamber 2 receiving the filter 33. The upper end 23 of the drive shaft 9 extends through the fluid-tight wall 38 in a portion 39 thereof which forms the lower portion of the conduit 36 and this passage itself is fluid-tight, that is to say, is produced by a device 40 having sealing joint(s) (for example of the stuffing box type) which provide(s) the sealing between the rotating drive shaft 9 and the wall 38.

The main liquid outlet 37 out of the hollow body 1 is provided with a protective grill 41 which guides the flux generated in a normal pumping direction and which prevents the passage of debris in the backflow direction towards the inner side of the hollow body 1 when the propeller 10 is driven in a backward direction counter to the normal pumping direction.

The control unit 4 is preferably located out of the liquid and is configured to provide, via the cable 3, a supply voltage to the motor 8. This supply voltage, depending on its polarity, allows the motor 8 to be controlled in one direction or the other and in accordance with different rotation speeds. Such a control unit 4 can be formed by an electrical power supply which is branched with respect to the mains supply and which comprises a pulse width modulation control logic unit which controls a circuit which forms a voltage source (based on at least one transistor in commutation) whose output is chopped at high frequency with a pulse width which is variable in accordance with the signal provided by the control logic unit. The control unit 4 comprises an inversion circuit which allows a supply voltage to be provided for the motor 8 whose polarity can be changed (positive polarity for driving in a forward direction; negative polarity for driving in a backward direction) and whose mean value can be modified owing to the pulse width modulation logic in order to take a value from a plurality of different values which correspond to several drive speeds of the motor 8, respectively, and therefore to several movement speeds of the apparatus. The sign + indicates a movement in a forward direction; the sign − indicates a movement in a backward direction. In the example, if it is desirable for the apparatus to be able to move at a normal predetermined speed +V in a forward direction, at a first speed −V1 in a backward direction or at a second speed −V2 in a backward direction, the control logic unit can be programmed so that the control unit 4 provides a voltage whose mean value can take, at an absolute value, a value selected from three predetermined values corresponding to these three speeds.

The control unit 4 may advantageously incorporate a time delay logic unit which allows the various drive directions and the various speeds to be controlled in accordance with periods of time which are predetermined, fixed and stored and/or defined randomly, for example by a pseudo-random variable generator. Such a control unit 4 is particularly simple in terms of its design and production.

In a first rotation direction of the motor 8 and the shaft 9 thereof, the front drive wheels 5 are rotatably driven in the forward movement direction of the apparatus (FIGS. 7 and 11*a*, and FIG. 14, the small wheel 6 being at the rear of the drive axle in contact with the immersed surface). In this first rotation direction, the axial pumping propeller 10 is driven in the normal pumping direction of the liquid from the opening 25 at the base of the hollow body 1 as far as the outlet 37 via which the liquid is discharged. The shutter 31 is open and the pieces of debris drawn in via the opening 25 with the liquid are retained in the filter 33.

In this first rotation direction, the motor 8 is controlled at a predetermined speed so that the apparatus is moved forwards at a predetermined speed +V, called a normal speed, which is as rapid as possible in order to optimize the cleaning. Preferably, the normal speed +V corresponds to the maximum rotation speed of the motor 8. When the apparatus is thus driven forwards, its trajectory is normally in a straight line orthogonal with respect to the axis 13 of the axle 7, the two front wheels 5 being parallel with each other and orthogonal relative to the axis 13, and the small wheel 6 being in contact with the immersed surface.

In the other rotation direction of the motor 8, the front drive wheels 5 are rotatably driven in a backward movement direction of the apparatus (FIGS. 8 and 15, the small wheel 6 being in front of the drive axle 7 relative to this movement direction). In this second rotation direction, the axial pumping propeller 10 is driven in the opposite direction to its normal pumping direction and generates a non-zero flow of liquid in a backward direction from the outlet 37 to the inner side of the hollow body 1. The propeller 10 is an axial pumping propeller which has unidirectional pitch and which is preferably fixed (having blades which are rigidly fixed to a rotor and which extend radially relative thereto having a pitch in only one direction) and which generates a flow of liquid which is generally orientated in accordance with the rotation axis thereof (the propeller 10 therefore not being of the centrifugal type) in one direction or the other in accordance with the direction of rotation of the propeller about the axis thereof. The propeller 10 is optimized to generate an optimum flow when it is rotatably driven about its axis in the normal pumping direction. However, when it is rotatably driven about the axis thereof in an opposite direction to this normal pumping direction, the propeller generates a non-zero flow of liquid in a backward direction.

And, against all expectations in this matter, not only is this backward flow in reality not disadvantageous for the general operation of the apparatus, but it is instead particularly advantageous and in particular allows:

- a hydraulic reaction to be applied which can be involved in the nosing-up action of the apparatus which brings about modifications of the trajectory of the apparatus during its movements in a backward direction, in terms of gyration at one side or the other,
- hydraulic fluxes optionally to be generated which are orientated laterally and which are directly involved by means of reaction in the trajectory modifications of the apparatus, in terms of gyration at one side or the other,
- the walls of the filter 33 to be periodically unclogged, which serves to increase the service-life of the apparatus and to optimize the operational volume of the filter 33.

In this second rotation direction of the motor 8, the shutter 31 is automatically in a closed position (owing to gravity and/or under the action of the flux in a backward direction), preventing any backflow of debris into the conduit 28 so that the pieces of debris remain confined inside the filter 33. The flux in a backward direction can be discharged via the inevitable leakages of the apparatus (this being able to have no specific discharge hole or valve for the flux in a backward direction), or via one or more specific hole(s) having valve(s) provided in the shell 11 for this purpose, for example a lateral hole (variant which is not illustrated).

The trajectory modifications of the apparatus during its movements in a backward direction (compared with its trajectory in a forward direction which is in a straight line in the example) can be obtained in all appropriate ways, particularly by means of modification of the position of the hollow body 1 relative to the axle 7 about the axis 13 (in a plane which is orthogonal with respect to the immersed surface and which contains the movement direction).

Preferably, the apparatus is designed so as to be able to be driven in gyration at one side (for example to the left relative to its movement direction) for a first speed of the motor 8 corresponding to a first speed of movement of the apparatus in a backward direction and to a first nosed-up position (first embodiment illustrated) or non-nosed-up position (second embodiment illustrated) of the apparatus, and in gyration at the other side (for example to the right relative to its movement direction) for a second speed of the motor 8 corresponding to a second speed −V2 of movement of the apparatus in a backward direction and to a second nosed-up position of the apparatus. In this way, there is obtained in an extremely simple manner an apparatus which, in the forward direction, moves in a straight line and, in a backward direction, depending on the rotation speed of the motor 8, moves by turning to the left or by turning to the right. Consequently, all the useful trajectories of a cleaning apparatus are obtained, which greatly facilitates the cleaning coverage and the rapidity of cleaning the immersed surface.

The increase in the movement speed in a backward direction generates an acceleration which brings about an inertia torque which tends to increase the nosing-up action of the apparatus. The general balance of the apparatus can be adapted in order to obtain the desired positions which are nosed-up to a greater or lesser extent or non-nosed-up in accordance with the various corresponding speeds.

In a variant which is not illustrated, the pumping device may also be involved in the placement into (a) nosed-up position(s). In this regard, it should be noted that the pumping propeller 10 is a propeller with unidirectional pitch which is directly coupled so as to be fixedly joined in terms of rotation to the rear upper end 23 of the drive shaft 9. An axial pumping propeller with unidirectional pitch comprises blades which generally extend radially and which have a pitch which is preferably fixed but which could be variable, but which, in any case, does not change direction, that is to say, is always orientated in a single direction, so that the liquid flux direction generated by the rotation of the propeller is dependent on the rotation direction thereof. When the propeller 10 is rotatably driven in the normal pumping direction (corresponding to the cleaning of the immersed surface), it pumps the liquid from each liquid inlet at the base of the hollow body as far as each main liquid outlet. When the propeller 10 is rotatably driven in a backward direction, it pumps the liquid in the direction of the backflow from each main liquid outlet.

The axial pumping propeller 10 which is driven in a backward direction generates a flow of liquid which can to be discharged from the hollow body via at least one liquid outlet, called a secondary outlet (not illustrated). The liquid flow which is discharged via at least one such secondary outlet is orientated so that this flow creates, by means of reaction, forces whose resultant, which is called a secondary hydraulic reaction force, generates a nosing-up torque of the apparatus by pivoting the hollow body about the axle 7. This nosing-up torque about the axis 13 of the drive axle 7 tends to nose-up the apparatus, that is, to raise the small wheel 6. In this manner, such a secondary hydraulic reaction force applies a pivot torque of the apparatus about the axis 13 of the drive axle 7 in the direction in which the nosing-up action of the apparatus is increased. To this end, it is necessary and sufficient for the orientation of the liquid flux generated in a backward direction and being discharged via such a secondary outlet not to intersect with the axis 13 of the drive axle 7, and to be orientated in the correct direction.

However, such an involvement of the liquid flow in a backward direction in placing the apparatus in a nosed-up state is not necessary and, in the embodiment illustrated by way of example, obtaining each nosed-up position results only from the drive torque on the drive axle and the general equilibrium of the apparatus.

Conversely, there is nothing to prevent the placement of the apparatus in a nosed-up position from resulting mainly, even only, from such a secondary hydraulic reaction force. For example, the invention may be used for an embodiment which is not illustrated in which an apparatus according to the invention is driven only by means of hydraulic reaction with no mechanical transmission between the motor and the axle of the front wheels.

Trajectory modifications can be obtained in accordance with the position, which is nosed-up to a greater or lesser extent or non-nosed-up, that is to say, in accordance with the inclination of the hollow body 1 about the axis 13 of the drive axle 7 relative to the immersed surface, for example (variant not illustrated) owing to the fact that the horizontal component (parallel with the immersed surface) of the hydraulic advance resistance in the backward direction is unbalanced and produces a gyration at one side of the apparatus. To this end, the shell 11 may have shutters or ribs whose hydraulic effect is dependent on the nosed-up inclination of the apparatus.

According to another variant which is not illustrated, they can be obtained by laterally offsetting a guiding and driving member and/or brushing member, or in accordance with a spontaneous pivoting of a small wheel following the change in movement direction.

In a variant or in combination, trajectory modifications can be obtained by means of different configurations of the guiding and driving members in contact with the immersed surface and/or by laterally offset braking members which may or may not come into contact with the immersed surface in accordance with the nosed-up position of the apparatus.

In the first embodiment illustrated, the shell 11 has a wall portion 42 which extends forwards from the opening 25, over the entire width thereof, substantially conforming to the contour of the front wheels 5. This wall portion 42 is provided with two runners 43, 44, each runner being arranged so as to be able to come into contact with the immersed surface in order to locally brake and/or raise the hollow body 1 if the apparatus takes up a specific predetermined nosed-up position for each runner 43, 44, the small wheel 6 being disengaged from said immersed surface.

A first fixed runner 43 is arranged at one side, for example at the right-hand side as illustrated, so as to be integral with the front portion 42 of the shell 11 and extends so as to protrude radially outwards from this portion 42 in order to come into contact with the immersed surface when the apparatus is in a first nosed-up position illustrated in FIG. 11*b*, for the first slow movement speed −V1 in a backward direction corresponding to the first slow rotation speed of the motor 8. In this first nosed-up position, the second runner 44 is not in contact with the immersed surface and the apparatus is driven in gyration at one side (to the left relative to the movement direction in the example illustrated) and in a backward direction owing to the friction of the first runner 43 on the immersed surface and/or disengagement of the front right wheel 5. The first runner 43 is arranged at the front of the drive axle and, in the first nosed-up position, comes into contact with the immersed surface at the rear of the drive axle relative to the movement direction (backward direction).

The second fixed runner 44 is arranged at the other side, for example at the left-hand side as illustrated, integral with the front portion 42 of the shell 11 and which extends so as to protrude radially outwards from this portion 42 in order to come into contact with the immersed surface when the apparatus is in a second nosed-up position illustrated in FIG. 11*c*, which has a greater inclination than the first nosed-up position. This second nosed-up position is obtained for the second rapid speed −V2 of movement in a backward direction which corresponds to the second rapid rotation speed of the motor 8. In this second nosed-up position, the first runner 43 is no longer in contact with the immersed surface and the apparatus is driven in gyration at the other side (to the right in the example illustrated) in a backward direction owing to the friction of the second runner 44 on the immersed surface and/or disengagement of the front left wheel 5. The second runner 44 is also arranged at the front of the drive axle and, in the second nosed-up position, comes into contact with the immersed surface at the rear of the drive axle relative to the movement direction (backward direction).

The first runner 43 is arranged so as to come into contact with the immersed surface only in said first nosed-up position and the second runner 44 is arranged so as to come into contact with the immersed surface only in said second nosed-up position. In particular, in the first nosed-up position, the second runner 44 is not in contact with the immersed surface. In the second nosed-up position, the first runner 43 is not in contact with the immersed surface. In the normal movement position of the apparatus in which it is not nosed-up, since all the wheels 5, 6 are in contact with the immersed surface, for example during the movements in a forward direction, the runners 43, 44 are remote from the immersed surface and are therefore inactive.

A runner 43, 44 which is capable of causing a drive wheel 5 to become disengaged produces a rapid gyration of the apparatus by means of localized stoppage. A runner 43, 44 which is capable of rubbing against the immersed surface without causing a drive wheel 5 to become disengaged produces a slower gyration of the apparatus by localized braking. These two variants can be envisaged in an apparatus according to the invention, and can be combined (at least one braking runner being provided for only rubbing on the immersed surface and locally braking in one position of the apparatus; at least one other disengagement runner producing a disengagement of a wheel in another position of the apparatus).

In the second embodiment illustrated, the runners 43, 44 are replaced by small wheels 63, 64. In particular, the first runner 43 is replaced by a small wheel 63 which is mounted so as to pivot freely about a horizontal transverse axis in an oblong groove 65 which is provided in a pivoting arm 66. The small wheel 63 can move in translation along the oblong groove 65. The pivoting arm 66 can freely pivot about a transverse horizontal axis 71 relative to the shell 11 which forms a chassis.

In the embodiment illustrated, the pivoting arm 66 has two parallel wings 66*a*, 66*b* which form a cover for receiving the small wheel 63 which has a central shaft 67, each wing 66*a*, 66*b* having an oblong aperture 65*a*, 65*b*, the two parallel oblong apertures 65*a*, 65*b* facing each other and having the same dimensions constituting the oblong groove 65 in which the shaft 67 of the small wheel 63 is guided. The shaft 67 of the small wheel 63 has ends which are engaged in each oblong aperture 65*a*, 65*b*.

When the apparatus is driven forwards, the apparatus is in a normal non-nosed-up movement position and the small wheel 63 is in abutment at the rear end 70 of the groove 65 and simply rolls normally, freely and without resistant force, in contact with the immersed surface.

When the apparatus is driven backwards at the first slow speed, the small wheel 63 moves along the oblong groove 65, towards the front end thereof. By doing this, the arm 66 pivots slightly downwards. When the small wheel 63 arrives in abutment against the front end 69 of the oblong groove 65, it is blocked in terms of rotation, locally brakes the apparatus and lifts it in order to disengage the wheel 5 from the immersed surface, the apparatus being driven in terms of gyration. It should be noted that, in this second embodiment of the invention, in the backward movement direction at the first slow speed, the apparatus remains in a normal non-nosed-up movement position. That is to say, said first movement position of the apparatus in a backward direction is, in this second embodiment, a normal non-nosed-up position.

The second runner 44 of the first embodiment is replaced, in the second embodiment, by a small wheel 64 which can freely pivot about a horizontal transverse axis, which produces disengagement of the front left wheel 5 as the apparatus is driven in a backward direction at the second speed −V2 and is in the second position thereof, which is a nosed-up position.

A braking portion is advantageously provided so as to be integral with the shell 11 in order to brake and block the small wheel 63 in terms of rotation in abutment at the front end 69 of the groove 65.

Preferably, the small wheels 63, 64 are toothed in order to minimize their sliding with respect to the immersed surface and, in the case of the first small wheel 63, with respect to the shell 11 (braking portion). Advantageously, a rack 68 which corresponds to the teeth of the first small wheel 63 is provided so as to be integral with the shell 11 in order to bring about a rotation (the first small wheel 63 engaging on the rack 68) and a translation movement of the small wheel 63 in the oblong groove 65 in the backward movement direction, and to block the small wheel 63 in terms of rotation when it arrives in abutment at the front end 69 of the oblong groove 65. The rack 68 is preferably arranged so as to be integral with the shell 11 in order to bring about downward pivoting of the arm 66 and a downward movement, relative to the shell 11, of the small wheel 63 when it arrives at the front end 69 of the groove 65, in order to bring about a disengagement of the wheel 5 which is adjacent to the small wheel 63.

The control unit 4 is extremely simple in terms of its design and production. It is configured so that the apparatus is principally driven forwards in a straight line. The motor 8 is interrupted from time to time and controlled in a backward direction at the first slow speed (corresponding to the movement speed −V1) from time to time and at the second rapid speed (corresponding to the movement speed −V2) from time to time. The different time periods for control of the motor 8: T1 in a forward direction at rapid speed +V, T2 in a backward direction at slow speed −V1, T3 in a backward direction at normal rapid speed −V2, and T4 the interruptions of the motor 8, are defined in a random manner (by a random generator, that is to say, a pseudo-random variable generator) and/or in a predetermined manner. Preferably, these time periods can be defined so as to limit the entanglement of the cable 3, that is to say, ensuring that the totals of the periods of time of gyration to the left are similar to the totals of the periods of time of gyration to the right.

For example, T1 is between 10 sec. and 1 min., for example in the order of 20 sec.; T2 and T3 are both less than T1, for example between 3 sec. and 15 sec., in particular between 5 sec. and 8 sec.; and T4 is less than each of the periods of time T1, T2 and T3 and is between 0.5 sec. and 5 sec., in particular in the order of 2 sec. The value V corresponds to the maximum speed of the motor 8 (no pulse width modulation of the voltage supplied by the control unit 4), V1 corresponds to 50% of the maximum speed of the motor (V1=0.5V) and V2 corresponds to 80% of the maximum speed of the motor (V2=0.8V). Of course, other values are possible.

It should be noted that the control of each nosed-up position of the apparatus does not require a particularly complex operational logic unit in so far as it can be obtained by means of simple balance of the apparatus during production. Furthermore, the presence of the runners 43, 44 or small wheels 63, 64 facilitates this control, each of these runners 43, 44 or the small wheel 64 acting as a stop which limits the pivoting in each nosed-up position. Furthermore, this control can remain relatively imprecise in so far as the periods of time for placing the apparatus in a nosed-up position are short, this movement configuration not corresponding to the normal cleaning configuration.

The apparatus according to the invention is extremely simple in terms of design and construction and therefore very economical but nevertheless very efficient. With a single electric motor 8 and a control unit 4 which is reduced to its most simple form, all the most complex functionalities of an electrical apparatus are obtained. The apparatus according to the invention is further particularly light, easy to handle, ergonomic and particularly aesthetic. It consumes very little energy and is environmentally friendly. It has a great service-life and excellent inherent reliability in particular of the small number of components which it contains.

The invention may include numerous variants from the preferred embodiment illustrated in the Figures and described above. In particular, the invention can be used equally well in an apparatus which is provided with motorized or non-motorized guiding and driving members other than wheels (chains, brushes, etc.). Also, the apparatus may have several liquid inlets, several liquid outlets, even several pumping propellers which are driven by the same motor. However, one advantage of an apparatus according to the invention is that it is able to have only one liquid inlet 25, only one liquid outlet 37, only one hydraulic circuit and only one axial pumping propeller 10 which is coupled directly to the drive shaft 9 of the electric motor 8. The motor 8 can be driven in accordance with a discrete plurality of speeds which may comprise more different speeds than in the example described above. The runners 43, 44 or small wheels 63, 64 may be replaced or supplemented by any other combination of localized braking member(s) and/or localized disengagement. For example, there may be provided at least one braking member and/or disengagement member, by means of friction and/or rolling, which is generally centered in a median direction of the axle (not laterally offset), for example a disengagement member which produces, in a predetermined nosed-up position of the apparatus, a disengagement of the two drive wheels 5 and a random gyration of the apparatus owing to the inevitable imbalances thereof (for example owing to the necessarily offset traction of the electrical power supply cable).

The apparatus according to the invention advantageously has no actuator or an on-board logic circuit and/or electronic circuit. In variants, there is nothing to prevent the apparatus from being able to comprise, if necessary, on-board electronic components and/or actuators. For example, the control unit could be on-board, including for example with a series of on-board accumulators which act as a source of electrical energy, the apparatus being completely independent.

The invention claimed is:

1. A swimming pool cleaner configured for travel along an immersed surface and comprising:

a. a body;

b. means for moving the body, such means comprising a wheel, a motor connected to the wheel to cause rotation thereof, and an axle connected to the wheel; and c. a control unit electrically connected to the motor so as to drive the motor at (i) a first speed, at which the body moves in accordance with a first trajectory, and (ii) a second speed, faster than the first speed, at which the apparatus pivots about the axle so as to be at least partially raised relative to the immersed surface and moves in accordance with a second trajectory different than the first trajectory.

2. A swimming pool cleaner according to claim 1 further comprising first and second localized contact members, each offset laterally from the axle and configured to contact the immersed surface.

3. A swimming pool cleaner according to claim 2 in which the apparatus may pivot about the axle so as to assume first and second positions at least partially raised relative to the immersed surface, the first localized contact member contacting the immersed surface when the apparatus is in the first position and the second localized contact member contacting the immersed surface when the apparatus is in the second position.

4. A swimming pool cleaner according to claim 3 in which the first localized contact member is positioned opposite the axle from the second localized contact member.

5. A swimming pool cleaner according to claim 4 in which the first localized contact member contacts the immersed surface only when the apparatus is in the first position and the second localized contact member contacts the immersed surface only when the apparatus is in the second position.

6. A swimming pool cleaner according to claim 1 further comprising a pumping device comprising:

a. a propeller; and b. a reversible electric pumping motor comprising a shaft connected to the propeller.

7. A swimming pool cleaner according to claim 6 in which the body has a main outlet and a secondary outlet and, when the propeller rotates in a first direction, water is propelled through the main outlet and when the propeller rotates in a second direction opposite the first direction, water is propelled through the second outlet.

8. A swimming pool cleaner according to claim 1 further comprising a pumping device comprising a propeller and in which the motor comprises a shaft connected to the propeller.

9. A swimming pool cleaner according to claim 8 in which the body has a main outlet and a secondary outlet and, when the propeller rotates in a first direction, water is propelled through the main outlet and when the propeller rotates in a second direction opposite the first direction, water is propelled through the second outlet.

10. A swimming pool cleaner according to claim 1 further comprising a mechanical transmission connecting the motor to the wheel.

* * * * *